United States Patent [19]

Theurer et al.

[11] Patent Number: 4,627,360

[45] **Date of Patent: * Dec. 9, 1986**

[54] MOBILE TRACK LEVELING, LINING AND TAMPING MACHINE

[75] Inventors: Josef Theurer, Vienna; Johann Hansmann, Klosterneuburg, both of Austria

[73] Assignee: Franz Plasser Bahnbaumaschinen-Industriegesellschaft m.b.H, Vienna, Austria

[ * ] Notice: The portion of the term of this patent subsequent to Aug. 13, 2002 has been disclaimed.

[21] Appl. No.: 618,121

[22] Filed: Jun. 7, 1984

[30] Foreign Application Priority Data

Oct. 5, 1983 [AT] Austria ..... 3534/83

[51] Int. Cl.[4] ..... E01B 29/17

[52] U.S. Cl. ..... 104/7.2; 104/12

[58] Field of Search ..... 104/2, 7 R, 7 B, 12

[56] References Cited

U.S. PATENT DOCUMENTS

| | | | |
|---|---|---|---|
| 3,534,687 | 10/1970 | Plasser et al. | 104/12 |
| 3,595,170 | 7/1971 | Plasser et al. | 104/12 |
| 3,795,198 | 3/1974 | Plasser et al. | 104/12 |
| 4,066,020 | 1/1978 | Theurer | 104/7 B |
| 4,094,250 | 6/1978 | Theurer | 104/12 |
| 4,258,627 | 3/1981 | Theurer | 104/12 |
| 4,323,013 | 4/1982 | Theurer | 104/7 B |
| 4,457,234 | 7/1984 | Theurer et al. | 104/12 X |

OTHER PUBLICATIONS

09-CSM advertisement, "Der Eisenbahningenieur", No. 6, Jun. 1983.

*Primary Examiner*—Randolph A. Reese
*Attorney, Agent, or Firm*—Kurt Kelman

[57] ABSTRACT

A mobile track leveling, lining and tamping machine has a machine frame supported on undercarriages for continuous movement in an operating direction, a power plant and operating controls carried by the machine frame, a tool carrier frame having a front end and a rear end, and an undercarriage supporting and guiding the tool carrier frame rear end on the track. Tamping tool assemblies are mounted on the tool carrier frame immediately ahead of the undercarriage supporting and guiding the tool carrier frame rear end for tamping ballast in intermittent tamping cycles under respective ties at points of intersection of the two rails and the ties in tangent and switch track sections and a track lifting and lining unit is associated with the two rails mounted on the tool carrier frame ahead of the tamping tool assemblies and is arranged on the tool carrier frame between two undercarriages spaced in the direction of the track for lifting and lining the track in tangent and switch track sections. A longitudinally adjustable coupling device pivotally links the front end of the tool carrier frame to the machine frame, the tool carrier frame having a lateral pivoting range sufficient to pivot and guide the tool carrier frame in switch track sections.

10 Claims, 5 Drawing Figures

MOBILE TRACK LEVELING, LINING AND TAMPING MACHINE

The present invention relates to improvements in a mobile machine for leveling, lining and tamping a track consisting of two rails fastened to successive ties resting on ballast, which comprises a machine frame supported on undercarriages for continuous movement in an operating direction, a power plant and operating control means carried by the machine frame, a tool carrier frame having a front end and a rear end, and an undercarriage supporting and guiding the tool carrier frame rear end on the track. Tamping means is mounted on the tool carrier frame immediately ahead of the undercarriage supporting and guiding the tool carrier frame rear end, the tamping means being arranged for tamping ballast in intermittent tamping cycles under respective ones of the ties at points of intersection of the two rails and the respective ties, and track lifting and lining means is associated with the two rails mounted on the tool carrier frame ahead of the tamping means in the operating direction and is arranged on the tool carrier frame between two undercarriages spaced in the direction of the track for lifting and lining the track, track leveling and lining reference systems being associated with the track lifting and lining means. A longitudinally adjustable coupling device pivotally links the front end of the tool carrier frame to the machine frame.

U.S. Pat. Nos. 4,534,295 and 4,596,193, both filed May 26, 1983, disclose a mobile track leveling, lining and tamping machine of this type and a model of such a non-stop advancing machine has been successfully built and operated, as reflected in an advertisement of the 09-CSM in "Der Eisenbahningenieur", No. 6, June 1983. This machine for the first time met the practical requirements and solved the problems encountered in the operation of continuously advancing tampers. A substantial part of the weight and operating forces of the tamping, track lifting and lining means is transmitted to the track through the undercarriage supporting the tool carrier frame for stop-and-go movement while the machine frame advances non-stop so that the latter is subjected to substantially smaller static and dynamic loads than in machines wherein the individual tamping heads are longitudinally displaced on guides along the machine frame. At the same time, heavy impacts and vibrations are kept from the operator's cab on the machine frame so that the working conditions of the operator are considerably enhanced. This practical non-stop tamper has opened up a number of developmental possibilities and has initiated a new generation of track working machines.

U.S. Pat. No. 4,066,020, dated Jan. 3, 1978, discloses a mobile track leveling, lining and tamping machine adapted for use in tangent and switch track sections. The machine frame is an elongated carrier beam carrying a power plant and operating control means and supported on undercarriages for movement in an operating direction. The machine frame also supports tamping means arranged for tamping ballast in intermittent tamping cycles under respective ones of the ties at points of intersection of the two rails and the respective ties in tangent and switch track sections, the tamping means comprising a respective tamping tool assembly associated with each rail, and further comprising transversely extending guide means supporting each tamping tool assembly independently on the tool carrier frame, and independently operable, separate drives for displacing each tamping tool assembly independently along the guide means for transverse adjustment in relation to the associated rail. Each tamping tool assembly comprises pairs of vibratory tamping tools arranged on pivotal yokes straddling the associated rail for reciprocation in a plane extending in the direction of the rails. Furthermore, track lifting and lining means associated with the two rails is mounted on the elongated carrier beam ahead of the tamping means in the operating direction and is arranged on the elongated carrier beam between two undercarriages spaced in the direction of the track for lifting and lining the track in tangent and switch track sections. The track lifting and lining means comprises a carriage mounted for mobility on the track on two pairs of flanged lining rollers respectively engaging each rail, a vertically and laterally adjustable lifting hook mounted on the carriage between each pair of flanged lining rollers for engagement with a respective one of the rails, drive means for vertically and laterally adjusting the lifting hooks, and lifting and lining drives linking the carriage to the elongated carrier beam. Leveling and lining reference systems are mounted on the elongated carrier beam for movement with the machine. Such switch tampers have been very successfully used since the independent transverse displaceability of the tamping tool assemblies associated with the respective rails enables the machine to be used effectively even in very difficult track sections, such as frogs, switch rails and the like, for leveling and/or lining such track sections and tamping the track sections in their corrected position. However, some operating efficiency is lost, particularly in working on tangent track.

It is the primary object of this invention to provide a track leveling, lining and tamping machine effective for operation in the most difficult track sections, such as switches, while maintaining a high level of operating efficiency in tangent track, too.

The above and other objects are accomplished in a track leveling, lining and tamping machine of the first-described type by arranging the tamping means and the track lifting and lining means for lifting, lining and tamping in tangent and switch track sections, the tool carrier frame having a lateral pivoting range sufficient to pivot and guide the tool carrier frame in switch track sections.

Such a machine has all the advantages of the continuously advancing machine disclosed in our copending applications while making it possible to pivot the tool carrier frame with its supporting and guiding undercarriage in switches and branch tracks deviating from a main track at a switch sufficiently to center the tamping means and track lifting and lining means over their respective rails, independently of the position of the machine frame. Since the tamping means is arranged on the tool carrier frame immediately ahead of the undercarriage supporting and guiding the tool carrier frame rear end, the tamping tools will be automatically centered with respect to the rails since the undercarriage runs on the track rails immediately adjacent the tamping tools. Thus, it is fundamentally not necessary to provide for the transverse displacement of the tamping tool assemblies on the pivoting tool carrier frame if it is desired to economize in the construction of the machine. The same considerations hold for the track lifting and lining means mounted ahead of the tamping means and, therefore, capable of gripping the track in just about any track switch section. The structure of the machine is relatively simple and produces high-quality tamping in track switches at an enhanced operating efficiency, the machine being operable alternatively in tangent track and switches without interruption at unchanging efficiency. Furthermore, the increased work comfort of the operators riding on the machine frame, which is free of the vibrations and impacts emanating from the tool carrier frame, is of particular advantage in monitoring the difficult operations in switches.

The above and other objects, advantages and features of the present invention will become more apparent from the following detailed description of certain now preferred embodiments thereof, taken in conjunction with the accompanying, partly schematic drawing wherein FIG. 1 is a side elevational view of a mobile track leveling, lining and tamping machine according to this invention;

Figure 1:
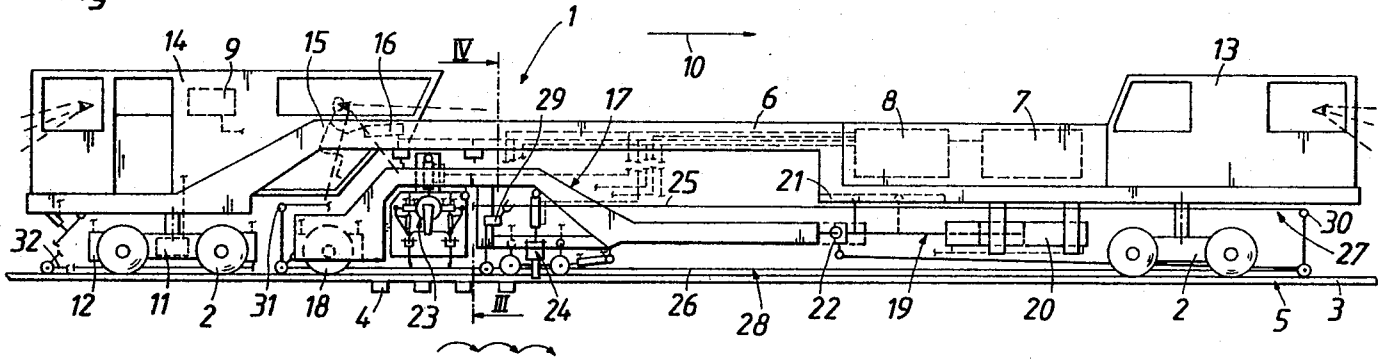
Figure 2:
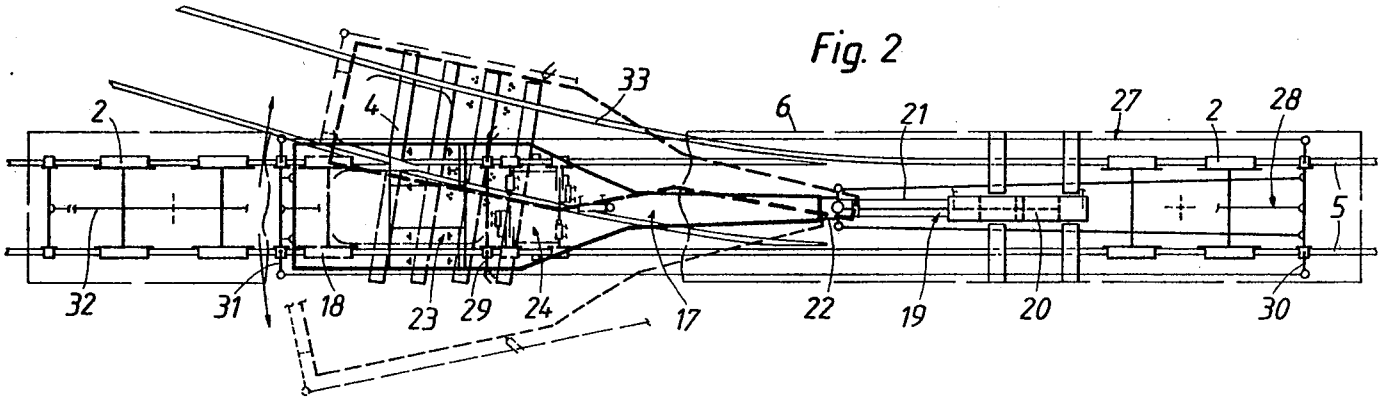
FIG. 2 is a diagrammatic top view of the machine.

Referring now to the drawing and first to FIGS. 1 and 2, there is shown mobile machine 1 for leveling, lining and tamping track 5 consisting of two rails 3 fastened to successive ties 4 resting on ballast. As will become apparent, the machine is adapted for use in tangent and switch track sections. It comprises elongated machine frame 6 supported on undercarriages constituted by swivel trucks 2 at the front and rear ends of the elongated machine frame and drive 11 propels the machine frame for continuous movement in an operating direction indicated by arrow 10. Power plant 7, 8 and operating control means 9 are carried by machine frame 6 which may be stopped by brake 12. Operator's cabs 13 and 14 are mounted on the machine frame at the ends thereof, main cab 14 at the rear end of machine frame 6, in the operating direction, being an elongated cab extending between two longitudinal beams of the machine frame and having a large forwardly facing window. Operator's cab 14 houses drive and control panel 16 connected to central control 9.

Swivel trucks 2 are spaced apart a substantial distance to provide a long wheelbase for machine frame 6 and tool carrier frame 17 is arranged between the swivel trucks. The elongated tool carrier frame has the form of a carriage with a central, forwardly projecting pole portion. Undercarriage 18 supports and guides the rear end of the tool carrier frame on the track, the tool carrier frame partially subtending cab 14 with the undercariage supporting the tool carrier frame rear end. This arrangement keeps the operating tools in clear sight of the operator in cab 14 in every position of tool carrier frame 17 to enable the operator to monitor the centering of the tools rapidly and precisely. This will enhance the efficiency of the tamping operation in switches. It will be useful to provide brake means for the wheels of undercarriage 18.

Longitudinally adjustable coupling device 19 pivotally links the front end, i.e. the forwardly projecting pole portion, of tool carrier frame 17 to machine frame 6 and the tool carrier frame has a lateral pivoting range (see FIG. 2) sufficient to pivot and guide the tool carrier frame in switch track sections. The illustrated coupling device is double-acting hydraulic adjustment drive 20 whose piston rod is supported by longitudinal guide 21 on machine frame 6 for longitudinal adjustment in relation to the machine frame, an end of the piston rod being pivotally connected to an end of the pole portion of tool carrier frame 17 by universal joint 22.

Tamping means 23 is mounted on tool carrier frame 17 immediately ahead of undercariage 18 and is arranged for tamping ballast in intermittent tamping cycles under respective ties 4 at points of intersection of the two rails 3 and the ties in tangent and switch track sections, and track lifting and lining means 24 associated with the two rails is mounted on the tool carrier frame ahead of tamping means 23 in the operating direction, the track lifting and lining means being arranged on tool carrier frame 17 between undercarriages 2 and 18 spaced in the direction of the track for lifting and lining the track in tangent and switch track sections. Specific tamping means and track lifting and lining means useful for operation in switches will be more fully described in connection with FIGS. 3 to 5.

Track leveling and lining reference systems 27, 28 are associated with track lifting and lining means 24 for control thereof, as is conventional. The illustrated reference systems comprise reference wires 25, 26 cooperating with track sensing element 29 positioned intermediate reference wire ends 30, 31 arranged on tool carrier frame 17 for movement therewith. For lining in tangent track, lining reference extension 32 mounted on machine frame 6 is used. This arrangement enables precise leveling, and also lining, in switches, particularly at the beginning of a branch track at a switch, since the reference systems move with the pivoting tool carrier frame.

Since the tamping means and the track lifting and lining means are mounted on tool carrier frame 17, the vibrations and repeated impacts to which this tool carrier frame is subjected are not transmitted to machine frame 6 on which the operator rides, thus affording the operating personnel more working comfort. At the same time, the two wheels of undercarriage 18 form a freely movable steering axle for the tool carrier frame to follow the track closely, also in switches, so that the operating tools will be automatically centered at all times, even in the most difficult track sections. As has been made evident in the selective positions of elongated tool carrier frame 17 indicated in broken lines in FIG. 2, such a long carriage with its central, forwardly projecting pole portion has great lateral freedom of movement, which is particularly useful in tamping the ties of a branch track 33 at a switch. Especially in tangent track, the machine may be used as a production tamper, with machine frame 6 continuously advancing in the operating direction while adjustment drive 20 is operated to advance tool carrier frame 17 intermittently from tamping cycle to tamping cycle.

Figure 3:
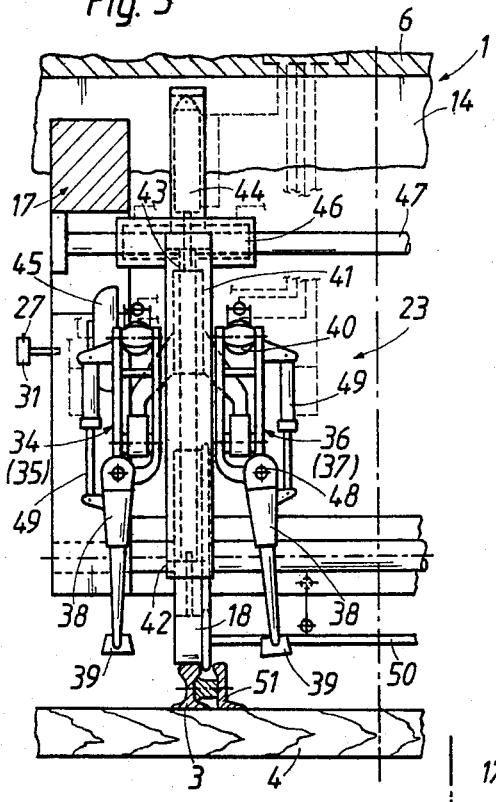
FIG. 3 is an enlarged cross section along line III—III of FIG. 1.

FIG. 3 illustrates one preferred embodiment of tamping means 23. As shown, the tamping means comprises a respective tamping tool assembly associated with each rail 3, each tamping tool assembly including pairs of tamping tools 34, 35 and 36, 37 for immersion in the two cribs adjacent a tie 4 to be tamped, the tie being interposed between the tamping tools of the pairs. The tamping tools are arranged for reciprocation in a plane extending in the direction of rails 3 to enable them to tamp ballast under the interposed tie when the tamping tools are squeezed together, reciprocating drives 40 being linked to the upper ends of the tamping tools to pivot them about an axis extending transversely to the direction of the rail. In the illustrated embodiment, the tamping tools are comprised of respective holders 38 replaceably receiving tamping picks 39 and the tamping picks are laterally pivotal in a plane extending perpendicularly to the place of reciprocation about axes 48 extending in the direction of the rail at the lower ends of the holders, independent hydraulic drives 49 being linked to the tamping picks for pivoting the same about axes 48. Each tamping tool assembly comprises tamping tool carrier 41 for the pairs of tamping tools 34, 35 and 36, 37 associated with each rail 3. The tamping tool carrier is vertically adjustably mounted on guide columns 43 connected by frame 42 and vertical adjustment drive 44 links the tamping tool carrier to the tool carrier frame for moving the tamping tool carrier up and down along the guide columns. Reciprocating drives 40 are linked to central vibrating drive 45 for imparting vibrations to the tamping picks. Transversely extending guide 47 supports each tamping tool assembly independently on tool carrier frame 17 and independently operable, separate drives 46 are actuatable to displace each tamping tool assembly independently along the guide for transverse adjustment in relation to associated rail 3. With such an arrangement of the tamping tools, it is possible to pivot individual tools out of the range of the track whenever the track formation would make it impossible to immerse a respective tamping tool in the ballast while the remaining tools may still be used for tamping. Since the pivoting axes of the tamping picks are at the lower ends of the tamping tool carriers, this pivotal bearing of the picks does in no way interfere with the reciprocation of the tamping tools. Providing for transverse displacement of the tamping tool assemblies assures precise centering of the tamping tools over the associated rails even in switches which are sharply curved, thus further improving the proper positioning of the tamping tools, in combination with the individual pivoting of the tools out of the range of the track in case of need.

As schematically indicated, rear end 31 of the leveling reference wire of reference system 27 is mounted on track sensing element 50 running on rollers on the track rails. The drives for the tamping means are controlled manually from drive and control panel 16 or, preferably, automatically by central control 9 connected to the panel. As shown in FIG. 3, the pair of tamping tools 36, 37 may be pivoted upwardly by drive 49 where a branch rail 51 would interfere with its operation while still enabling the pair of tamping tools 34, 35 to function.

Figure 4:
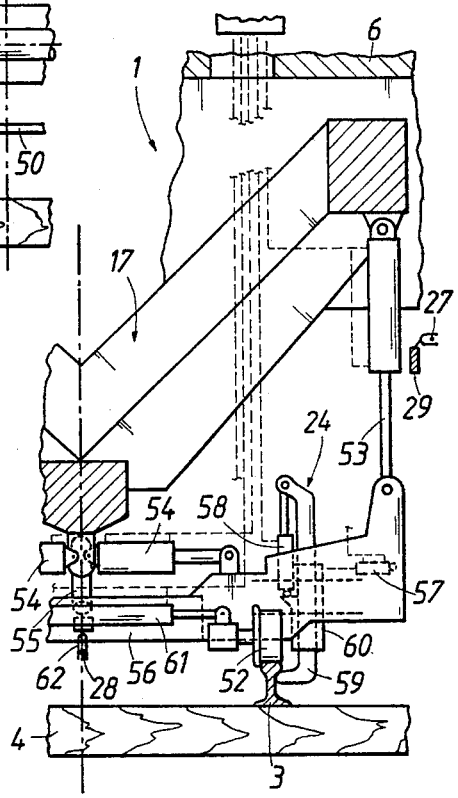
FIG. 4 is a like cross section along line IV—IV of FIG. 1.

FIG. 4 illustrates a preferred embodiment of track lifting and lining means 24 comprising vertically adjustable lifting hooks 59 and flanged lining rollers 52 arranged for engagement with each rail 3. Mounting such a track lifting and lining means with a tamping means adapted to operation in switches on a tamping tool carrier pivotally connected to a machine frame in accordance with the present invention enables all the operating tools to be rapidly and precisely adapted to a variety of track configurations to take into account very difficult operating conditions, such as encountered in switches, frogs, branch tracks at switches and the like, thus enabling any track section to be corrected and tamped, regardless of obstacles. Also, the pivotal tool carrier frame enables the machine to move into and out of switches without any difficulty.

Track lifting and lining means 24 comprises carriage 56 mounted for mobility on track 5 on two pairs of flanged lining rollers 52 respectively engaging each rail 3. Vertically and laterally adjustable lifting hook 59 is mounted on the carriage between each pair of flanged lining rollers for engagement with respective rail 3. Drives 57, 58 enable each lifting hook independently to be vertically and laterally adjusted. Each lifting hook is vertically displaceably mounted in guide block 60 and drive 58 links an upper end of lifting hook 59 to the guide block. Drive 57 links the guide block to carriage 56 for transverse displacement thereof. Lifting and lining drives 53 and 54 link carriage 56 to tool carrier frame 17. Additionally, drive 55 is linked to track lifting and lining carriage 56 for displacing the same in the direction of the rails so that the position of the track lifting and lining means in relation to tool carrier frame 17 may be longitudinally adjusted. This enables lifting hooks 59 to be properly positioned for engagement with the rails where a frog, for example, would make such engagement impossible. The lifting and lining means arrangement shown in FIG. 4 enables powerful lining forces to be transmitted to a heavy switch by respective pairs of lining rollers, the centrally positioned lifting hook assuring a vise-like connection of the track lifting and lining means with the track rail, thus assuring proper lifting and lining of the switch. Since the succeeding undercarriage 18 supports and guides tool carrier frame 17 on the track, the lifting and lining tools are always properly centered so that there rapid engagement with a respective track rail is possible in switches, too. At the same time, the strong vibrations and shocks emanating from the operating tools particularly in switch work are kept away from the operating personnel in the cab on the machine frame. Carriage 56 is a telescoping two-part structure whose parts are linked by spreading drive 61 so that the two parts of the carriage may be pressed apart in a direction extending transversely to track 5 whereby flanged lining rollers 52 are pressed against the track rails without play. The reference wire of lining reference system 28 runs through fork-shaped sensor 62 connected to a rotary potentiometer generating a control signal corresponding to the sensed track position for operating a respective lining drive 54 until the track has been laterally moved into the desired position. Similarly, sensor 29 of leveling reference system 27 generates a control signal operating lifting drives 53. The control and hydraulic supply lines for the drives of track lifting and lining means 24 are connected to power plant and operating control means 7, 8, 9 of machine 1.

Figure 5:
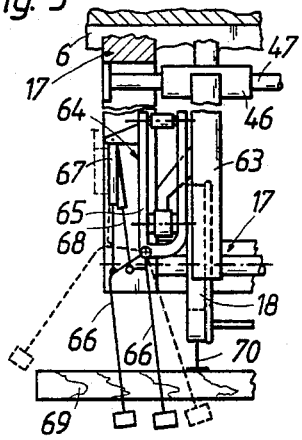
FIG. 5 is a diagrammatic and fragmentary end view of another embodiment of a tamping tool assembly useful in the machine.

FIG. 5 illustrates another preferred embodiment of the tamping means for use in switches, which comprises respective tamping tool assembly 64 associated with each rail. The tamping tool assembly comprises pairs of tamping tools 65 arranged for reciprocation in a plane extending in the direction of rails 70 of a switch. The tamping tools have two tamping picks 66 laterally pivotal in a plane extending perpendicularly to the plane of reciprocation, as is shown by the positions of the tamping picks indicated in broken lines. Independently operable, separate drives 67, 68 pivot each tamping pick independently of each other. In this way, one of the tamping picks may be pivoted out of the way while the other pick remains in operating position for tamping ballast under tie 69 and may even be further pivoted towards switch rail 70 to enable ballast to be tamped under this rail. As in the embodiment of FIG. 3, drive 46 enables the tamping tool assembly to be displaced transversely along guide 47. This tamping tool arrangement with two independently pivotal tamping picks enables the tamping tool assembly to be even better adapted to all kinds of track configurations, thus assuring a continuous and even tamping of the ballast in the most difficult track sections.

Mobile track leveling, lining and tamping machine 1 operates in the following manner:

Since coupling device 19 is an adjustment drive 20 having an adjustment path of a length equal to at least two tie spacings, machine frame 6 may be halted while work is done in a switch or it may be continuously advanced, particularly in tangent track, while tool carrier frame 17 is intermittently advanced, the actuation of drive 20 being controlled, for example, by limit switches responsive to the upward movement of the tamping tool carriers at the end of a tamping cycle to advance the tamping tool carrier rapidly into a forward end position indicated in broken lines for centering the tamping tools over the next succeeding tie. After centering tamping means 23 over this tie, the next tamping cycle is initiated by lowering the tamping tool carriers and thus tripping the limit switches for the control of the various tool drives. Meanwhile, machine frame 6 may advance continuously in the operating direction indicated by arrow 10 so that the switch to be leveled, lined and tamped is spared the impacts due to the stop-and-go movement of conventional heavy switch tampers. The mass of tool carrier frame 17, which advances intermittently, is much smaller and the corresponding impacts are, therefore, considerably reduced, being kept away entirely from the operating personnel riding on the continously advancing machine frame. This smaller mass enables the centering of the tools to be readily corrected if the original positioning is not satisfactory. If the tamping tool assemblies are, additionally, transversely displaceable so that their position in relation to the track is independent of the tool carrier frame position, the adaptability of the machine to even the most difficult track configurations is further enhanced.

When the machine reaches a switch encumbered by many obstacles in the way of proper rail engagement by the lifting and lining tools and of immersion of the tamping picks in the ballast, as shown in FIG. 2, the machine operation may, nevertheless, be continued without substantial decrease in the operating efficiency. The machine may continue to advance along the main track for a short distance while the initial portion of the switch may still be effectively tamped, due to the lateral pivoting of tool carrier frame 17. Leveling and lining also may continue without interruption because leveling and lining reference systems 27, 28 travel with the tool carrier frame. Where the branch rails at the switch pose particular difficulties, drive 20 may be actuated for improving the centering of tamping means 23 which are mounted on tool carrier frame 17. Such a correcting move in the operating direction may be coupled with a correcting move in the transverse direction (by displacing the tamping tool assemblies along guide 47 on the tool carrier frame) to obtain optimal centering of the tamping tools and avoid all obstacles, such as branch rails, frogs and the like. The operator at control panel 16 is able to monitor the operation effectively since he has a clear and unencumbered view of the tamping zone through the large window at the front of cab 14 which is in direct view of the operating site and, if required, can operate selected pivoting drives 49, 67, 68 for moving desired tamping picks 38, 66 out of the way of obstacles (see FIGS. 3 and 4). If operations are particularly difficult, machine frame 6 may be halted during each tamping cycle so that machine 1 as a whole advances intermittently.

What is claimed is:

1. A mobile machine for leveling, lining and tamping a track consisting of two rails fastened to successive ties resting on ballast, the machine being adapted for use in tangent and switch track sections, which comprises (a) a machine frame supported on undercarriages for continuous movement in an operating direction, (b) a power plant and operating control means carried by the machine frame, (c) a tool carrier frame having a front end and a rear end, (d) an undercarriage supporting and guiding the tool carrier frame rear end on the track, (e) tamping means mounted on the tool carrier frame immediately ahead of the undercarriage supporting and guiding the tool carrier frame rear end, the tamping means comprising pairs of tamping tools associated with each rail, the tamping tools being arranged for reciprocation in a plane extending in the direction of the rails and at least some of the tamping tools being laterally pivotal in a plane extending perpendicularly to the plane of reciprocation, and the tamping means being arranged for tamping ballast in intermittent tamping cycles under respective ones of the ties at points of intersection of the two rails and the respective ties in tangent and switch track sections, (f) track lifting and lining means associated with the two rails mounted on the tool carrier frame ahead of the tamping means at a fixed distance therefrom in the operating direction and comprising vertically adjustable lifting hooks and flanged lining rollers arranged for engagement with each rail, the track lifting and lining means being arranged on the tool carrier frame between two undercarriages spaced in the direction of the track for lifting and lining the track in tangent and switch track sections, (g) track leveling and lining reference systems associated with the track lifting and lining means, and (h) a longitudinally adjustable coupling device pivotally linking the front end of the tool carrier frame to the machine frame, the tool carrier frame having a lateral pivoting range sufficient to pivot and guide the tool carrier frame in switch track sections.

2. The mobile track leveling, lining and tamping machine of claim 1, wherein the tool carrier frame has the form of a carriage with a central, forwardly projecting pole portion.

3. The mobile track leveling, lining and tamping machine of claim 1, wherein at least one of said pairs of tamping tools is comprised of respective tamping tools having two tamping picks laterally pivotal in the plane extending perpendicularly to the plane of reciprocation, and independently operable, separate drives for pivoting each one of the tamping picks independently of each other.

4. The mobile track leveling, lining and tamping machine of claim 1, wherein the tamping means comprises a respective tamping tool assembly associated with each rail, and further comprising transversely extending guide means supporting each tamping tool assembly independently on the tool carrier frame, and independently operable, separate drives for displacing each tamping tool assembly independently along the guide means for transverse adjustment in relation to the associated rail.

5. The mobile track leveling, lining and tamping machine of claim 1, wherein the track lifting and lining means comprises a carriage mounted for mobility on the track on two pairs of flanged lining rollers respectively engaging each rail, the vertically and laterally adjustable lifting hook being mounted on the carriage between each pair of flanged lining rollers for engagement with a respective one of the rails, drive means for vertically and laterally adjusting the lifting hooks, and lifting and lining drives linking the carriage to the tool carrier frame.

6. The mobile track leveling, lining and tamping machine of claim 1, wherein the coupling device is an adjustment drive having an adjustment path of a length being equal to at least two tie spacings whereby the machine frame may be halted or continuously advanced while the tool carrier frame is intermittently advanced.

7. The mobile track leveling, lining and tamping machine of claim 1, further comprising an operator's cab mounted on the machine frame, the tool carrier frame partially subtending the cab with the undercarriage supporting the tool carrier frame rear end.

8. The mobile track leveling, lining and tamping machine of claim 1, wherein the tamping means comprises pairs of tamping tools associated with each rail, the tamping tools being arranged for reciprocation in a plane extending in the direction of the rails and being comprised of respective holders and tamping picks laterally pivotal in a plane extending perpendicularly to the plane of reciprocation about axes extending in the direction of the rail.

9. The mobile track leveling, lining and tamping machine of claim 8, wherein the tamping means further comprises a tamping tool carrier for the pairs of tamping tools associated with each rail, a reciprocating drive for the tamping tool carrier and the pivoting axis of each pair of tamping tools extending below the reciprocating drive at the lower end of the tamping tool carrier.

10. The mobile track leveling, lining and tamping machine of claim 1, wherein the reference systems are arranged for movement with the tool carrier frame.

* * * * *